US005610690A

United States Patent [19]

Yoshihara et al.

[11] Patent Number: 5,610,690

[45] Date of Patent: Mar. 11, 1997

[54] ELECTROPHOTOGRAPHIC APPARATUS AND PROCESS CARTRIDGE FEATURING AN ELECTROPHOTOGRAPHIC PHOTOSENSITIVE MEMBER HAVING A SURFACE LAYER OF LUBRICATIVE FLUORINE-CONTAINING RESIN POWDER

[75] Inventors: Toshiyuki Yoshihara, Kawasaki; Hideki Anayama; Itaru Yamazaki, both of Yokohama; Hideyuki Ainoya; Hidetoshi Hirano, both of Tokyo; Mayumi Kimura, Kawasaki, all of Japan

[73] Assignee: Canon Kabushiki Kaisha, Tokyo, Japan

[21] Appl. No.: 616,767

[22] Filed: Mar. 15, 1996

Related U.S. Application Data

[63] Continuation of Ser. No. 293,325, Aug. 22, 1994, abandoned.

[30] Foreign Application Priority Data

Aug. 30, 1993 [JP] Japan ..... 5-235894

[51] Int. Cl.[6] ..... G03G 5/00

[52] U.S. Cl. ..... 399/167; 430/58; 399/111; 399/279

[58] Field of Search ..... 355/211, 245, 355/251; 430/58, 96

[56] References Cited

U.S. PATENT DOCUMENTS

| | | | |
|---|---|---|---|
| 4,356,245 | 10/1982 | Hosono et al. | 430/122 |
| 4,457,257 | 7/1984 | Murakami et al. | 355/251 X |
| 4,877,701 | 10/1989 | Hiro et al. | 430/58 X |
| 5,254,423 | 10/1993 | Mayama et al. | 430/58 |
| 5,258,811 | 11/1993 | Miyake et al. | 355/245 X |
| 5,294,967 | 3/1994 | Munakata et al. | 355/245 X |
| 5,298,948 | 3/1994 | Kurisu | 355/245 |
| 5,369,475 | 11/1994 | Kashiwagi | 355/245 |

FOREIGN PATENT DOCUMENTS

| | | |
|---|---|---|
| 0294097 | 12/1988 | European Pat. Off. . |
| 0300426 | 1/1989 | European Pat. Off. . |
| 0501497 | 9/1992 | European Pat. Off. . |
| 54-42141 | 4/1979 | Japan . |
| 55-18659 | 2/1980 | Japan . |
| 4-170560 | 6/1992 | Japan . |
| 4-212184 | 8/1992 | Japan . |
| 2028176 | 3/1980 | United Kingdom . |
| 2167199 | 5/1986 | United Kingdom . |

OTHER PUBLICATIONS

Patent Abstracts of Japan, vol. 16, No. 481, Oct. 6, 1992.
Patent Abstracts of Japan, vol. 16, No. 555, Nov. 25, 1992.
European Search Report.

*Primary Examiner*—William J. Royer
*Attorney, Agent, or Firm*—Fitzpatrick, Cella, Harper & Scinto

[57] ABSTRACT

An electrophotographic apparatus includes an electrophotographic photosensitive member, a charging member, an imagewise exposure system, a developing system having a toner feed member, a transfer system, and a cleaning system wherein the electrophotographic photosensitive member includes a surface layer containing a lubricative, fluorine-containing resin powder and the toner feed member includes a spacer member coming into contact with the surface layer of the electrophotographic photosensitive member; and also a process cartridge than can be detachably mounted on the electrophotographic apparatus.

16 Claims, 1 Drawing Sheet

ELECTROPHOTOGRAPHIC APPARATUS AND PROCESS CARTRIDGE FEATURING AN ELECTROPHOTOGRAPHIC PHOTOSENSITIVE MEMBER HAVING A SURFACE LAYER OF LUBRICATIVE FLUORINE-CONTAINING RESIN POWDER

This application is a continuation of application No. 08/293,325 filed Aug. 22, 1994, now abandoned.

BACKGROUND OF THE INVENTION

1. Field of the Invention

This invention relates to an electrophotographic apparatus, and more particularly to an electrophotographic apparatus in which a spacer member of a toner feed member is brought into contact with the surface of an electrophotographic photosensitive member so that the electrophotographic photosensitive member and the toner feed member can be positionally adjusted to each other. This invention also relates to a process cartridge that can be detachably mounted on the electrophotographic apparatus.

2. Related Background Art

Electrophotographic apparatuses such as copying machines and printers comprise an electrophotographic photosensitive member around which a charging means, an exposure means, a developing means, a transfer means, a cleaning means and so forth are provided. In particular, in the step of development where toner particles are made to adhere to the photosensitive member in accordance with electrostatically charged images formed on its surface, the gap between the toner feed member having toner particles and the photosensitive member has a very great influence on the images. This gap must be of an appropriate extent and also be uniform. If this gap is too wide, the toner adheres to the photosensitive member with difficulty to cause a decrease in image density. If on the other hand it is too narrow, the toner adheres to the photosensitive member with ease to make fine-line images thick, or the toner adheres to areas that should not undergo development, to cause fog.

In particular, in the case of what is called jumping development, the gap between the surface of the photosensitive member and the surface of the toner feed member must be kept more uniform since any variations of the gap between them has a great influence, as disclosed in Japanese Patent Application Laid-open No. 54-42141 and No. 55-18659.

As a method for positionally adjusting the toner feed member and the photosensitive member, there is a method in which a toner feed member is provided with, for example, spacer rolls made of resin, serving as a spacer member, and the spacer member is brought into contact with the surface of the photosensitive member.

In this method, however, the spacer member tends to damage a surface layer of the photosensitive member to cause separation of its photosensitive layer from its support. This tends to more remarkably occur when the peripheral speed of the toner feed member is set higher than the peripheral speed of the photosensitive member in order to increase toner density.

Of course, the spacer member may be so designed as to be brought into contact with areas outside the area in which the photosensitive layer is formed. In such an instance, however, it becomes necessary as a matter of course to make the support of the photosensitive member longer. This undesirably makes the whole apparatus larger in size. In addition, the toner tends to adhere to the portion where the spacer member is brought into contact and also it is difficult to clean such a portion, tending to cause faulty images.

As image quality has been made increasingly higher in recent years, studies have been conducted to make toners have a smaller particle diameter, to make drive systems have a smaller pitch non-uniformity and also, in printers to which images are inputted according to digital signals, to make picture element density higher. In such electrophotographic apparatuses, images are more remarkably affected unless the gap between the toner feed member and the photosensitive member is uniform.

SUMMARY OF THE INVENTION

An object of the present invention is to provide an electrophotographic apparatus which has an electrophotographic photosensitive member having a surface layer not tending to be damaged and not tending to cause separation of its photosensitive layer, and which can stably obtain good images.

Another object of the present invention is to provide a process cartridge that can be detachably mounted on the above electrophotographic apparatus.

The present invention provides an electrophotographic apparatus comprising an electrophotographic photosensitive member, a charging means, an imagewise exposure means, a developing means having a toner feed member, a transfer means, and a cleaning means;

said electrophotographic photosensitive member comprising a surface layer containing a lubricative resin powder; and said toner feed member comprising a spacer member coming into contact with the surface layer of said electrophotographic photosensitive member.

The present invention also provides a process cartridge that can be detachably mounted on the electrophotographic apparatus.

DESCRIPTION OF THE PREFERRED EMBODIMENTS

The electrophotographic apparatus of the present invention comprises an electrophotographic photosensitive member having a surface layer containing a lubricative resin powder, and a developing means having a toner feed member having a spacer member coming into contact with the surface layer of the electrophotographic photosensitive member.

Figure 1:
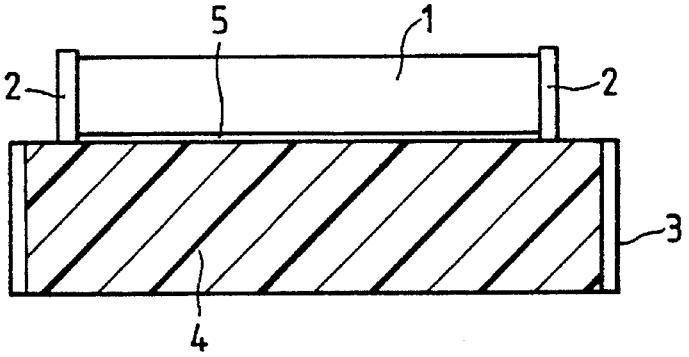
FIGS. 1 and 2 illustrate an example of the disposition of the electrophotographic photosensitive member and the toner feed member in the present invention.
Figure 2:
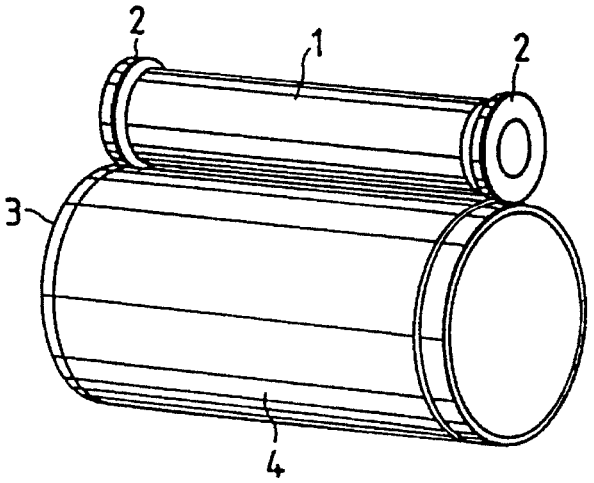

FIGS. 1 and 2 illustrate an example of the disposition of the electrophotographic photosensitive member and the toner feed member in the present invention. Reference numeral 1 denotes a toner feed member with a cylindrical form; 2, a spacer roll (a spacer member) provided on each end of the toner feed member; 3, an electrophotographic photosensitive member; 4, a photosensitive layer; and 5, a gap between the toner feed member and the photosensitive member.

The toner feed member may preferably have a cylindrical form, and may preferably be made of a metal or alloy such as aluminum, an aluminum alloy or stainless steel.

The spacer member 2 may preferably be brought into contact with the surface of the photosensitive member in a width (contact width) of from about 2 mm to about 5 mm at each end thereof, and may preferably be made of resin such as polyacetal, polyethylene or polypropylene. In order to assure a stable gap precision, the spacer member may preferably be brought into contact with the surface of the photosensitive member at a load of from about 100 g to about 1,000 g.

The ratio of a toner feed member peripheral speed to a photosensitive member peripheral speed should be set optimally taking account of various factors concerned with development, and may preferably be 1.1 to 3.

The electrophotographic photosensitive member has a photosensitive layer on a conductive support.

The photosensitive layer of the present invention may be either of what is called a double layer type, having a charge generation layer containing a charge-generating material and a charge transport layer containing a charge-transporting material, or what is called a single layer type, containing a charge-generating material and a charge-transporting material in the same layer, so long as the surface layer contains a lubricative resin powder in either case. In the present invention, in view of potential characteristics and durability, the photosensitive member may particularly preferably be an electrophotographic photosensitive member having the charge generation layer on the conductive support and having the charge transport layer on the charge generation layer.

The lubricative resin powder used in the present invention may preferably include fluorine-containing resin powders, polyolefin resin powders and silicon-containing resin powders. Of these, in view of lubricity, wear resistance, water repellency and so forth, fluorine-containing resin powders are particularly preferred.

The charge-generating material may include pyrylium dyes, thiopyrylium dyes, phthalocyanine pigments, anthanthrone pigments, quinone pigments, pyrathrone pigments and azo pigments. The charge generation layer can be formed by coating a dispersion prepared by dispersing any of these charge-generating materials in 0.5- to 4-fold amount of a binder resin using a solvent, followed by drying.

Such a binder resin may include polyvinyl acetals, polycarbonates, phenoxy resins and acrylic resins. In view of adhesion to other layers, polyvinyl acetals are particularly preferred, and polyvinyl butyral and polyvinyl benzal are more preferred.

The charge transport layer can be formed by coating a solution prepared by dissolving a charge-transporting material in a solvent together with a binder resin, followed by drying. The charge-transporting material can be exemplified by hydrazone compounds, stilbene compounds, pyrazoline compounds, oxazole compounds and triarylamine compounds.

The binder resin of the charge transport layer may be selected from a relatively wide range of insulating resins or organic photoconductive polymers. For example, the insulating resins include polycarbonates, polyallylates, polyesters, polyacrylates and polyurethanes. The organic photoconductive polymers include polyvinyl carbazole, polyvinyl anthracene and polyvinyl pyrene.

The electrophotographic photosensitive member having the photosensitive layer of a single layer type can be formed by coating on the conductive support a solution prepared by dispersing and dissolving the above charge-generating material and charge-transporting material in a binder resin solution, followed by drying.

The conductive support used in the present invention can be exemplified by those made of aluminum, an aluminum alloy, copper, zinc, stainless steel, vanadium, molybdenum, chromium, titanium, nickel, indium, gold and platinum. It is also possible to use supports comprised of plastics (as exemplified by polyethylene, polypropylene, polyvinyl chloride, polyethylene terephthalate and acrylic resins) having a film formed by vacuum deposition of any of these metals or alloys, supports comprising any of the above plastics, metals or alloys covered thereon with conductive particles (as exemplified by carbon black and silver particles) together with a suitable binder resin, and supports comprising plastics or paper impregnated with the conductive particles. The conductive support may have the form of a drum, a sheet or a belt, and may preferably have a form most suited for the electrophotographic apparatus to be used.

In the present invention, a subbing layer having a barrier function and an adhesion function may be provided between the conductive support and the photosensitive layer. The subbing layer may preferably have a layer thickness of not more than 5 μm, preferably from 0.1 μm to 3 μm. The subbing layer can be formed using casein, polyvinyl alcohol, nitrocellulose, polyamides such as nylon 6, nylon 66, nylon 610, copolymer nylon and alkoxymethylated nylon, polyurethanes, aluminum oxide or the like.

In the present invention, in order to protect the photosensitive layer from external mechanical and chemical ill influences, the photosensitive layer may also be provided thereon with a protective layer comprised of a resin layer or a resin layer containing conductive particles or a charge-transporting material. In this instance, the lubricative resin powder previously described is contained at least in this protective layer.

The electrophotographic photosensitive member of the present invention can be not only used in electrophotographic copying machines, but also widely used in the fields to which electrophotography is applied, e.g., laser beam printers, CRT printers, LED printers, liquid-crystal printers, laser lithography and facsimile machines.

Figure 3:
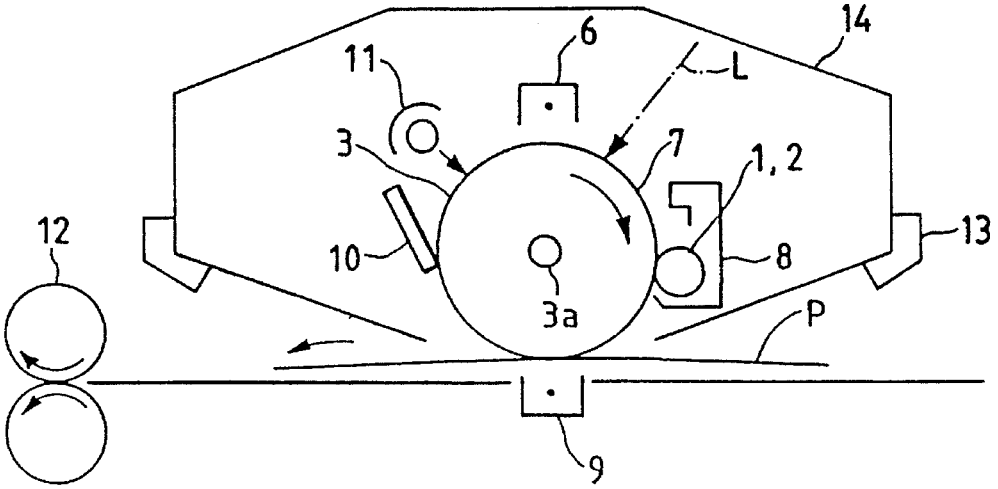
FIG. 3 schematically illustrates an example of the constitution of the electrophotographic photosensitive apparatus according to the present invention.

FIG. 3 schematically illustrates the construction of an electrophotographic apparatus of the present invention.

In FIG. 3, reference numeral 3 denotes an electrophotographic photosensitive member according to the present invention, which is rotated around a shaft 3*a* at a given peripheral speed in the direction shown by an arrow. In the course of rotation, the photosensitive member 3 is uniformly charged on its periphery, with positive or negative given potential by the operation of a charging means 6, and then photoimagewise exposed to light L by slit exposure or laser beam scanning exposure at an exposure zone 7 by the operation of an imagewise exposure means (not shown). As a result, electrostatic latent images corresponding to the exposed images are successively formed on the periphery of the photosensitive member.

The electrostatic latent images thus formed are subsequently developed by toner by the operation of a developing means 8 provided with a toner feed member 1 having a spacer member 2. The resulting toner-developed images are then successively transferred by the operation of a transfer means 9, to the surface of a transfer medium P fed from a paper feed section (not shown) to the part between the photosensitive member 3 and the transfer means 9 in the manner synchronized with the rotation of the photosensitive member 3.

The transfer medium P on which the images have been transferred is separated from the surface of the photosensitive member and led through an image-fixing means 12, where the images are fixed and then delivered to the outside as a transcript (a copy).

The surface of the photosensitive member 3 from which images have been transferred is brought to removal of the toner remaining after the transfer, using a cleaning means 10. Thus the photosensitive member is cleaned on its surface. Further, the charges remaining thereon are eliminated by the operation of a pre-exposure means 11. The photosensitive member is then repeatedly used for the formation of images.

In the present invention, the apparatus may be constituted of a combination of plural components joined as a process cartridge 14 (FIG. 3) from among the constituents such as the above photosensitive member 3, charging means 6, developing means 8 and cleaning means 10 so that the process cartridge can be freely mounted on or detached from the body of the electrophotographic apparatus such as a copying machine or a laser beam printer. For example, at least one of the charging means 6, the developing means 8 and the cleaning means 10 may be held into one cartridge together with the photosensitive member so that the process cartridge can be freely mounted on or detached from the body using a guide means 13 such as rails provided in the body of the apparatus.

The present invention will be further described below by giving Examples.

EXAMPLE 1

To an aluminum cylinder of 30 mm diameter and 260 mm long, a coating composition composed of the following materials was applied by dip coating, followed by heat curing at 140° C. for 30 minutes to form a conductive layer with a thickness of 20 μm. Conductive pigment: titanium oxide coated with tin

| | |
|---|---|
| Conductive pigment: titanium oxide coated with tin oxide-antimony oxide | 10 parts* |
| Resistance modifier pigment: titanium oxide | 10 parts |
| Binder resin: phenol resin | 10 parts |

-continued

| | |
|---|---|
| Leveling agent: silicone oil | 0.001 part |
| Solvent: methanol/methyl cellosolve in 1/1 weight ratio | 20 parts |

(*parts by weight; the sample applies hereinafter)

Next, a solution prepared by dissolving 3 parts of N-methoxymethylated nylon and 1 part of copolymer nylon in a mixed solvent of 40 parts of methanol and 20 parts of n-butanol was applied to the surface of the conductive layer by dipping, followed by drying to form a subbing layer with a layer thickness of 0.8 μm.

Next, 4 parts of an azo pigment represented by the formula:

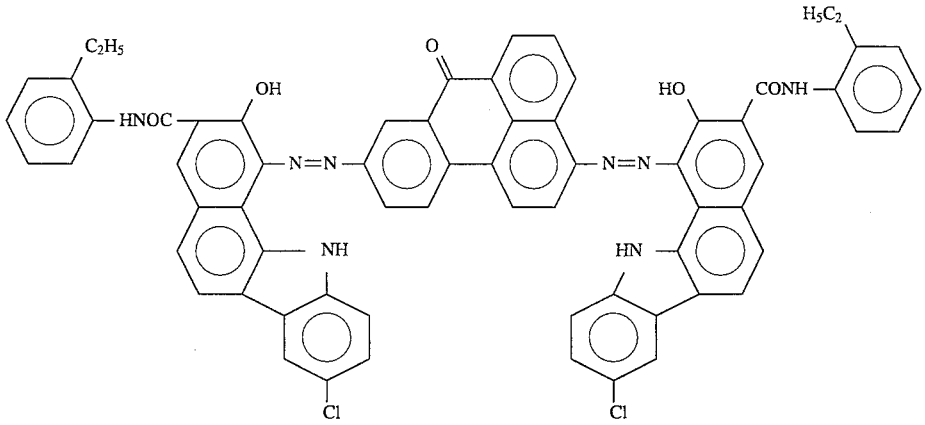

2 parts of polyvinyl butyral and 80 parts of cyclohexanone were dispersed for 50 hours by means of a sand mill grinder making use of glass beads of 1 mm diameter. Thereafter, to the resulting dispersion, 100 parts of tetrahydrofuran was added to obtain a charge generation layer coating dispersion. This coating dispersion was applied to the surface of the subbing layer by dipping, followed by drying to form a charge generation layer with a thickness of 0.2 μm.

Next, 7 parts of a charge-transporting material represented by the formula:

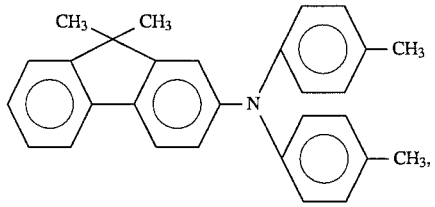

3 parts of a charge-transporting material represented by the formula:

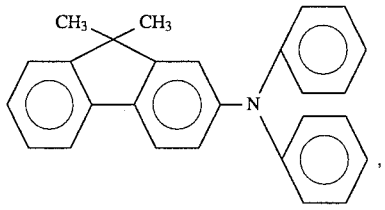

and 10 parts of polycarbonate-Z resin were dissolved in a mixed solvent of 50 parts of monochlorobenzene and 10 parts of dichloromethane. In the resulting solution, 1 part of polytetrafluoroethylene powder was added and dispersed, and the resulting dispersion was applied to the surface of the above charge generation layer by dipping, followed by drying to form a charge transport layer with a layer thickness of 25 μm.

The respective layers were so provided as to cover the support over the area up to 1 mm inward from its both ends.

This photosensitive member was fitted to a modified machine of a laser beam printer LBP-NX, manufactured by Canon Inc.

Its toner feed member was formed of a cylinder made of aluminum, and was provided with spacer members at its both ends in the manner that the gap between the toner feed member and the photosensitive member was kept at 300 μm. The spacer members each came in contact with the photosensitive member at a position covering 6 mm to 10 mm inward from each end of the photosensitive member. Each spacer member was in a contact width of 4 mm, and was made of polyoxymethylene. The peripheral speed of the toner feed member was set to be twice the peripheral speed of the photosensitive member.

The laser exposure was in a dot density of 600 dpi.

Using such an electrophotographic apparatus, a 20,000 sheet intermittent printing test was made. As a result, no damage was seen on the photosensitive layer at its areas coming into contact with the spacer members, and it was possible to stably obtain images free of uneveness.

COMPARATIVE EXAMPLE 1

A photosensitive member was produced in the same manner as in Example 1 except that no polytetrafluoroethylene powder was added to the charge transport layer. Evaluation was made similarly.

As a result, the photosensitive layer separated upon printing on 3,000 sheets to cause conspicuous uneveness on halftone images.

EXAMPLE 2

On an aluminum cylinder of 30 mm diameter and 346 mm long, a conductive layer and a subbing layer were formed in the same manner as in Example 1. Next, 4 parts of an azo pigment represented by the formula:

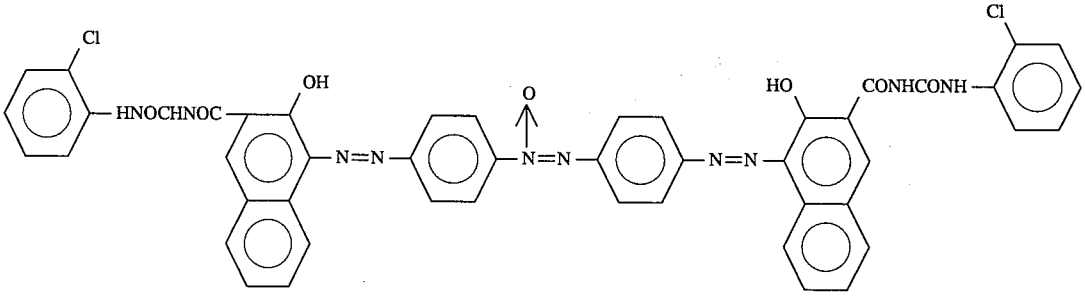

2 parts of polyvinyl (p-fluoro)benzal and 80 parts of cyclohexanone were dispersed for 30 hours by means of a sand mill grinder making use of glass beads of 1 mm diameter. Thereafter, to the resulting dispersion, 100 parts of tetrahydrofuran was added to obtain a charge generation layer coating dispersion. This coating dispersion was applied to the surface of the subbing layer by dipping, followed by drying to form a charge generation layer with a thickness of 0.2 μm.

Next, 10 parts of a charge-transporting material represented by the formula:

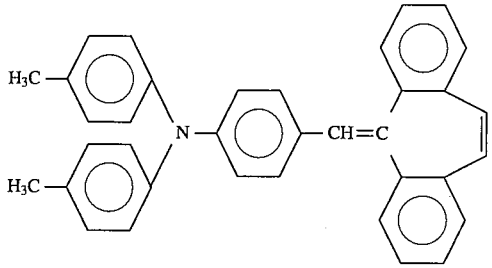

and 10 parts of polycarbonate-Z resin were dissolved in a mixed solvent of 50 parts of monochlorobenzene and 10 parts of dichloromethane. In the resulting solution, 2 parts of polytetrafluoroethylene powder was added and dispersed, and the resulting dispersion was applied to the surface of the above charge generation layer by dipping, followed by drying to form a charge transport layer with a layer thickness of 25 μm.

The respective layers were so provided as to cover the support over the area up to 1 mm inward from its both ends.

This photosensitive member was fitted to a modified machine of a plain-paper copying machine NP-2020, manufactured by Canon Inc. Its toner feed member was formed of a cylinder made of aluminum, and was provided with spacer members at its both ends in the manner that the gap between the toner feed member and the photosensitive member was kept at 300 μm. The spacer members each came in contact with the photosensitive member at a position covering 5 mm to 9 mm inward from each end of the photosensitive member. Each spacer member was in a contact width of 4 mm, and was made of high density polyethylene. The peripheral speed of the toner feed member was set 1.5 times the peripheral speed of the photosensitive member.

Using such an electrophotographic apparatus, a 40,000 sheet intermittent copying test was made. As a result, no damage was seen on the photosensitive layer at its areas coming into contact with the spacer members, and it was possible to stably obtain images free of uneveness.

EXAMPLE 3

A photosensitive member was produced in the same manner as in Example 1 except that the polytetrafluoroethylene powder was replaced with a polyvinylidene fluoride powder. Evaluation was made similarly.

As a result, in the 20,000 sheet intermittent printing, no damage was seen on the photosensitive layer at its areas coming into contact with the spacer members, and it was possible to stably obtain images free of uneveness.

EXAMPLE 4

A photosensitive member was produced in the same manner as in Example 1 except that as the binder resin of the charge generation layer the polyvinyl butyral was replaced with polymethyl methacrylate. Evaluation was also made similarly.

As a result, the photosensitive layer slightly separated upon printing on 15,000 sheets to cause slight uneveness on halftone images.

What is claimed is:

1. An electrophotographic apparatus comprising an electrophotographic photosensitive member, a charging means, an exposure means, a developing means having a toner feed member, a transfer means, and a cleaning means;

said electrophotographic photosensitive member comprising a surface layer containing a lubricative, fluorine-containing resin powder, wherein said surface layer comprises a photosensitive layer or a protective layer on said photosensitive layer; and said toner feed member comprising a spacer member coming into contact with the surface layer of said electrophotographic photosensitive member, wherein a peripheral speed of said toner feed member is higher than a peripheral speed of said electrophotographic photosensitive member.

2. An electrophotographic apparatus according to claim 1, wherein the peripheral speed of said toner feed member is 1.1 times to 3 times the peripheral speed of said electrophotographic photosensitive member.

3. An electrophotographic apparatus according to claim 1, wherein said electrophotographic photosensitive member has a charge generation layer on a conductive support and has a charge transport layer on the charge generation layer.

4. An electrophotographic apparatus according to claim 3, wherein said charge generation layer comprises a polyvinyl acetal.

5. An electrophotographic apparatus according to claim 4, wherein said polyvinyl acetal is selected from polyvinyl butyral and polyvinyl benzal.

6. An electrophotographic apparatus according to claim 1, wherein said surface layer is said photosensitive layer.

7. An electrophotographic apparatus according to claim 1, wherein said surface layer is said protective layer on said photosensitive layer.

8. An electrophotographic apparatus according to claim 1, wherein said spacer member contains a resin selected from the group consisting of polyacetal, polyethylene, and polypropylene.

9. A process cartridge comprising an electrophotographic photosensitive member and a means selected from the group consisting of a charging means, a developing means having a toner feed member, and a cleaning means;

said electrophotographic photosensitive member comprising a surface layer containing a lubricative, fluorine-containing resin powder, and the surface layer being brought into contact with a spacer member of said toner feed member, wherein said surface layer comprises a photosensitive layer or a protective layer on said photosensitive layer;

said electropotographic photosensitive member and said means being selected from the group consisting of a charging means, a developing means having a toner feed member, and a cleaning means being held into one unit so that the unit can be freely mounted on or detached from a body of an electrophotographic apparatus, wherein a peripheral speed of said toner feed member is higher than a peripheral speed of said electrophotographic photosensitive member.

10. A process cartridge according to claim 9, wherein the peripheral speed of said toner feed member is 1.1 times to 3 times the peripheral speed of said electrophotographic photosensitive member.

11. A process cartridge according to claim 9, wherein said electrophotographic photosensitive member has a charge generation layer on a conductive support and has a charge transport layer on the charge generation layer.

12. A process cartridge according to claim 11, wherein said charge generation layer comprises a polyvinyl acetal.

13. A process cartridge according to claim 12, wherein said polyvinyl acetal is selected from polyvinyl butyral and polyvinyl benzal.

14. A process cartridge according to claim 9, wherein said surface layer is said photosensitive layer.

15. A process cartridge according to claim 9, wherein said surface layer is said protective layer on said photosensitive layer.

16. A process cartridge according to claim 9, wherein said spacer member contains a resin selected from the group consisting of polyacetal, polyethylene, and polypropylene.

* * * * *